US012296429B2

(12) United States Patent
Naderer et al.

(10) Patent No.: US 12,296,429 B2
(45) Date of Patent: May 13, 2025

(54) BRAKING DEVICE FOR AN ORBITAL TOOL

(71) Applicant: FerRobotics Compliant Robot Technology GmbH, Linz (AT)

(72) Inventors: Ronald Naderer, Linz (AT); Georg Pree, Linz (AT)

(73) Assignee: FerRobotics Compliant Robot Technology GmbH, Linz (AT)

( * ) Notice: Subject to any disclaimer, the term of this patent is extended or adjusted under 35 U.S.C. 154(b) by 850 days.

(21) Appl. No.: 17/610,563

(22) PCT Filed: May 6, 2020

(86) PCT No.: PCT/EP2020/062515
§ 371 (c)(1),
(2) Date: Jun. 6, 2022

(87) PCT Pub. No.: WO2020/229247
PCT Pub. Date: Nov. 19, 2020

(65) Prior Publication Data

US 2022/0331933 A1 Oct. 20, 2022

(30) Foreign Application Priority Data

May 14, 2019 (DE) ..... 102019112556.1

(51) Int. Cl.
*B24B 47/26* (2006.01)
*B24B 23/03* (2006.01)
*B24B 27/00* (2006.01)

(52) U.S. Cl.
CPC ..... *B24B 47/26* (2013.01); *B24B 23/03* (2013.01); *B24B 27/0038* (2013.01)

(58) Field of Classification Search
CPC ..... B24B 23/02; B24B 23/022; B24B 23/028; B24B 23/005; B24B 47/26; B24B 41/002;
(Continued)

(56) References Cited

U.S. PATENT DOCUMENTS 2,669,072 A 2/1954 Grobey
5,595,531 A 1/1997 Niemela et al.
(Continued)

FOREIGN PATENT DOCUMENTS

CN 1294041 A 5/2001
CN 103862350 A 6/2014
(Continued)

*Primary Examiner* — Eric J Rosen
*Assistant Examiner* — John C Merino
(74) *Attorney, Agent, or Firm* — Murphy, Bilak & Homiller, PLLC

(57) ABSTRACT

The invention relates to a device with a machine tool and a braking device, the machine tool having an eccentrically supported, rotatable backing pad for receiving a tool. According to one embodiment, the braking device has a frame, which is attached to the machine tool; a spring, a first end of which is fixed on the frame; and a lever, which is connected to a second end of the spring. The braking device also has an actuator, which is designed to move the lever, wherein in the event of a movement of the lever, the spring is compressed and a part of the lever is pressed against the backing pad of the machine tool.

11 Claims, 2 Drawing Sheets

(58) Field of Classification Search
CPC ..... B24B 41/02; B24B 41/04; B24B 23/03; B24B 47/12; B24B 41/047; B24B 7/18; B24Q 11/0092
See application file for complete search history.

(56) References Cited

U.S. PATENT DOCUMENTS

| | | | | |
|---|---|---|---|---|
| 5,813,903 | A | 9/1998 | Amano et al. | |
| 8,517,799 | B2 | 8/2013 | Panergo et al. | |
| 2003/0017795 | A1 | 1/2003 | Walker | |
| 2015/0258703 | A1 | 9/2015 | Steingruber et al. | |
| 2016/0223035 | A1* | 8/2016 | Schinkel | F16D 51/22 |
| 2018/0147686 | A1 | 5/2018 | Valentini | |
| 2019/0084115 | A1* | 3/2019 | Hafele | B24B 23/026 |

FOREIGN PATENT DOCUMENTS

| | | | |
|---|---|---|---|
| DE | 10142557 | A1 | 3/2003 |
| DE | 102010012027 | A1 | 9/2011 |
| DE | 202013101858 | U1 | 5/2013 |
| DE | 102016106141 | A1 | 10/2017 |
| EP | 1277544 | A2 | 1/2003 |
| EP | 2366492 | A1 | 9/2011 |

* cited by examiner

BRAKING DEVICE FOR AN ORBITAL TOOL

TECHNICAL FIELD

The present description relates to the field of machine tools, in particular, to an orbital grinding machine for automated, robot-supported grinding.

BACKGROUND

When surfaces are machined with the support of a robot, a machine tool such as, e.g. a grinding or polishing machine (e.g. an electrically driven grinding machine with a rotating grinding disc as a tool), is guided by a manipulator, for example, an industrial robot. During this process, the machine tool can be coupled to the so-called Tool Center Point (TCP) of the manipulator in various ways. Generally the manipulator can adjust the machine to virtually any position and orientation and can move it, e.g. along a trajectory parallel to the surface of the workpiece. Industrial robots are usually position-controlled, which makes it possible to move the TCP with precision along the desired trajectory. The machining force between the machine tool and the surface of the workpiece can be adjusted and maintained independently of the manipulator by means of a separate actuator.

In many cases, eccentric grinders (e.g. orbital sanders) are employed, which have a grinding disc attached to a mounting plate (packing pad), wherein the backing pad rotates around a first, eccentrically arranged axis of rotation which itself rotates around a second, central axis of rotation. Orbital sanders are well known (see, e.g. U.S. Pat. No. 6,257,970 B1) and their functional principles will therefore not be discussed further here. Devices that allow for the automatic changing of grinding discs are also known (see, e.g. U.S. Pat. No. 8,517,799 B1). In the case of orbital sanders, the problem arises that the mounting plate comes to rest in an undefined position, whereas, in order to allow for an automated changing of the grinding disc, it would be preferable if the mounting plate was in a defined position at the beginning of the automated changing process. Furthermore, it often happens that the mounting plate continues to rotate for a considerable period of time after the motor is turned off, delaying the start of the changing process.

The inventor has set himself the task of improving orbital grinding machines with a speedier and more reliable automated process for changing grinding discs.

SUMMARY

An apparatus with a machine tool and with a braking device is described, wherein the machine tool comprises an eccentrically mounted, rotatable mounting plate for receiving a tool. In accordance with one embodiment, the braking device comprises a frame to which the machine tool is attached, a spring (in particular, a leaf spring), which is fixated to the frame at a first end, as well as a lever which is connected to a second end of the spring. The braking device further comprises an actuator which is configured to move the lever, wherein, when the lever is moved, the spring is tensioned and a part of the lever is pressed against the mounting plate of the machine tool.

BRIEF DESCRIPTION OF THE DRAWINGS

Embodiments are described in the following with reference to the examples illustrated in the drawings. The illustrations are not necessarily true to scale and the embodiments are not limited to the aspects illustrated here. Instead, importance is given to illustrating underlying principles of the embodiments. The figures show.

DETAILED DESCRIPTION

Before various embodiments are discussed in detail, first an example of a robot-supported grinding apparatus will be described. It is to be understood that the concepts described here may also be applied to other kinds of surface machining (in particular to polishing) and that they are not limited to grinding applications.

Figure 1:
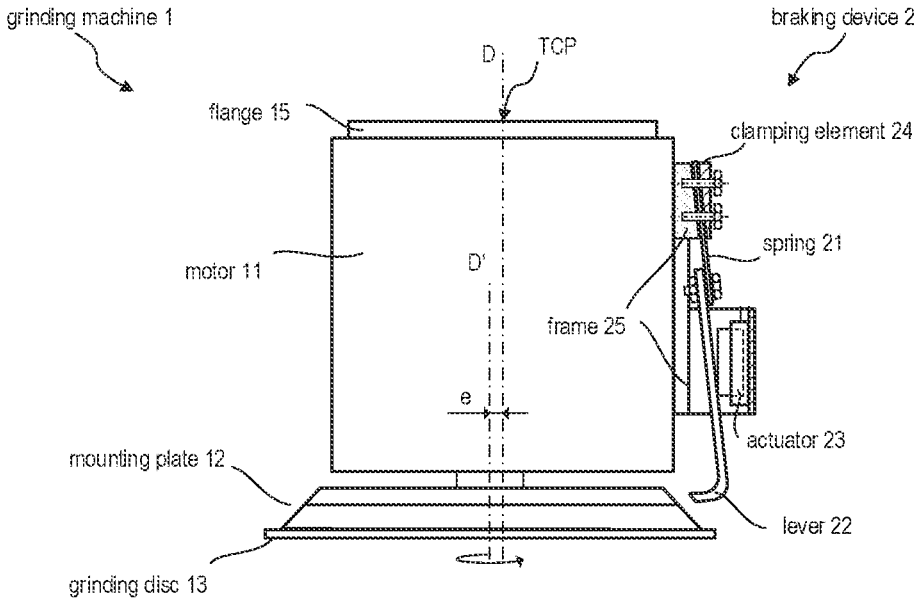
FIG. 1 illustrates an example of an orbital sander with a braking device in accordance with an embodiment.

FIG. 1 illustrates an example of an orbital sander with a braking device. Essentially the grinding machine 1 comprises a motor 11 for driving an eccentrically mounted (in a housing) mounting plate 12 (backing pad), to which a grinding disc 13 can be attached. When in operation, the eccentric mounting of the mounting plate 12 enables it to rotate around an eccentric axis of rotation D', which itself rotates around a central axis of rotation D. The causes the grinding disc 13 to complete a small elliptic movement while it is rotating (during which the elliptical orbit also rotates). The construction of an orbital sander is commonly known and will therefore not be explained here in detail. Of relevance for the further discussion, however, is the fact that, because of the eccentricity e of the axis of rotation D' (the distance between the axes of rotation D and IT), the resting position of the mounting plate 12 is not defined. After the motor 11 has been turned off, the mounting plate 12 continues to move for a while and can come to rest in virtually any angle position.

Figure 2:
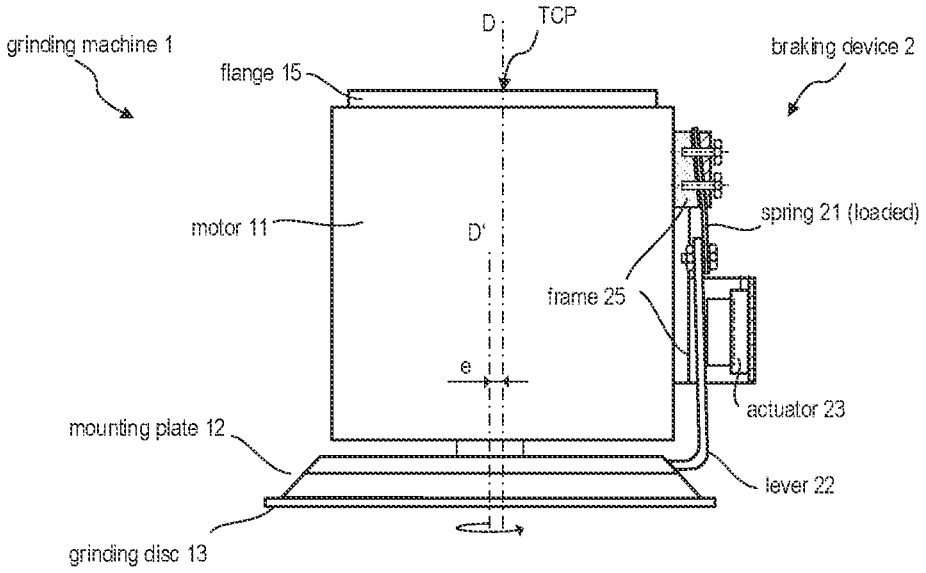
FIG. 2 shows the example from FIG. 1 with an activated braking device.

As mentioned above, it may prove to be an advantage for an automatic robot-supported changing of the grinding disc 13 if the mounting plate 12 is located in a defined angle position. In accordance with the embodiments described here, the grinding machine 1 comprises a braking device 2 which is configured to decelerate the mounting plate 12 (from the turned off motor 11) and to push it into a defined angle position. FIG. 2 shows the same embodiment as the one from FIG. 1 but with an activated brake.

In accordance with the embodiments shown in FIGS. 1 and 2, the braking device 2 includes a spring 21, in particular a leaf spring made of spring steel. One end of the spring 21 is clamped on a frame 25 of the braking device 2, for example, by means of a clamping element 24.

As shown in FIG. 1, the spring 21 is clamped between a part of the frame 25 and the clamping element, which can be attached to the frame 25 by means of screws. A lever 22 is mounted (e.g. also with screws) on the other end of the spring 21, which has the shape of an extended bar, bent at its free end at about 90°. The spring 21 and the lever 22 are positioned such that the free end of the lever 22 can be moved towards the mounting plate 12 until the free end of the lever 22 contacts a circumferential surface of the mounting plate 12. In the course of this movement of the lever 22, the spring is bent. The movement is effected by a linear actuator 23. The linear actuator may be a pneumatic actuator, implemented, for example, as a bellow cylinder. As an alternative, a magnetic actuator may also be used, which may be implemented, for example, as a solenoid actuator.

Regardless of the specific implementation, the actuator 23 takes affect between the frame 25 and the lever 22.

It is specifically the combination of the lever 22, mounted on the frame 25 by means of a leaf spring, with a direct drive (without a transmission or other mechanisms) such as, for example, a bellows cylinder, that enables the braking device (lever 22, spring 21) to operate without rotating joints. In other words, there is no need for a mechanism that includes parts that move towards each other. This renders the braking device 2 more robust and less prone to errors. The bellows cylinder does not contain any parts that move towards each other either, only the bellows is expanded by means of pressurized air, thereby pressing the end of the bellows cylinder against the lever 22.

When the brake is activated, the actuator 23 presses against the lever 22 and thus also presses the free bent end of the lever 22 against the mounting plate 12, by means of which the spring 21 is bent and tensioned. This situation is illustrated in FIG. 2. In that the free bent end of the lever 22 is pressed against the mounting plate 12, the latter is moved into a defined angle position. The eccentric axis of rotation D' is pushed as far as possible away from the braking device 2. In the example illustrated here, the braking device is disposed on the right side of the grinding machine 1 and the eccentric axis of rotation is pushed as far as possible to the left by the activated braking device. At the same time, any remaining rotational movement of the mounting plate 12 is slowed down until it comes to a rest.

Figure 3:
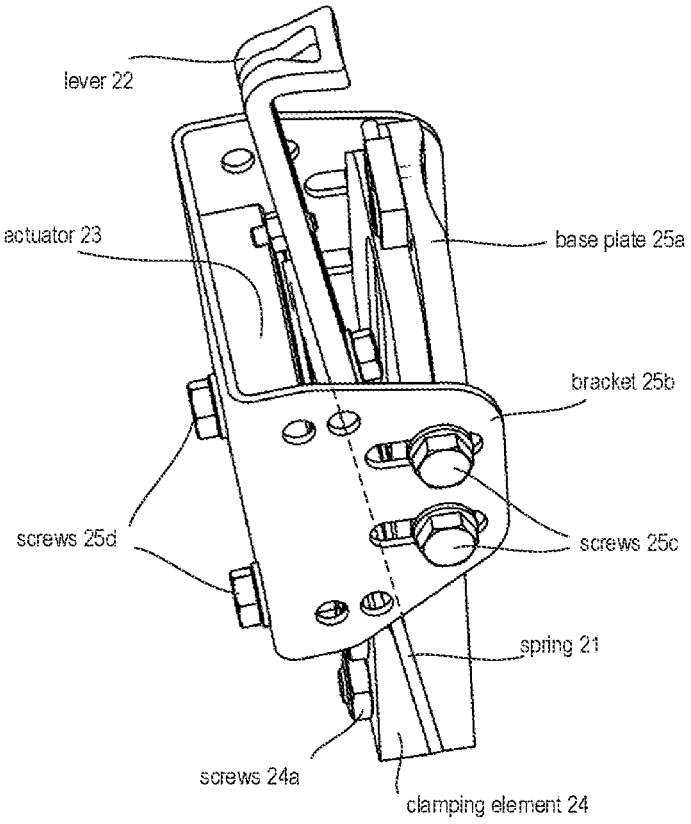
FIG. 3 illustrates an example of the braking device (without grinding machine) in greater detail.

FIG. 3 illustrates an exemplary implementation of the braking device 2 in a perspective view. The frame 25 is comprised of numerous parts and is designed to be mounted on a grinding machine (see FIGS. 1 and 2). The frame 25 includes a base plate 25*a* (support), the outer surface of which may be adapted to the (e.g. cylindrical) surface of the grinding machine. The spring 21 is attached to the base plate 25*a* by means of the clamping element 24 and screws 24*a*. Specifically, the spring 21, implemented as leaf spring, is clamped between a surface of the base plate 25*a* and a corresponding surface of the clamping element 24. The screws 24*a* provide the needed application force. The lever 22 is screwed together with the spring 21, as was also shown in FIG. 1. The lever 22 can thus be said to be an "extension" of the leaf spring 21, although the lever 22, in comparison to the spring 21, is rigid.

For attaching the actuator 23, the frame 25 includes a bracket 25*b*, which is mounted on the base plate 25*a* (e.g. by means of screws 25*c*) and which at least partially encloses the lever 22. The actuator 23 is mounted on the bracket 25*b* such that it can push the lever 22 towards the base plate 25*a* (and thereby, when in operation, towards the grinding machine). In the example illustrated here, the actuator 23 is attached, by means of the screws 25*d*, to the bracket 25*b* such that it can push the lever 22 towards the base plate 25*a* (and thereby also towards the grinding machine).

It is to be understood that the frame 25 may be constructed in a multitude of various designs. The construction illustrated in FIG. 3 can be modified in many different ways without changing the functionality of the braking device 2 described here. A frame is therefore to be understood as meaning any structural component, or assembly of structural components, which is suitable and designed to carry out the functions described here, namely and in particular to allow for the fixation of one end of the spring 21, as well as for the mounting of the actuator 23, in a manner that enables the latter to move the lever 22 attached to the spring 21. The frame itself is designed to be mounted onto the grinding machine.

In the following, a few important aspects of the embodiments described here will be summarized. This is not to be understood as an exhaustive, but only as a purely exemplary listing of some of the important aspects and technical features.

The embodiments described here concern an apparatus with a machine tool (in particular an orbital sander) and a braking device, wherein the machine tool comprises an eccentrically mounted, rotatable mounting plate for receiving a tool. In accordance with one embodiment, the braking device comprises a frame (see, e.g. FIG. 3, frame with base plate 25*a* and mounting bracket 25*b*), which is attached to the machine tool, a spring (see, e.g. FIGS. 1 and 2, leaf spring 21), which is fixed at one first end to the frame, as well as a lever (see, e.g. FIGS. 1 to 3, lever 22), which is connected to a second end of the spring. The braking device further comprises an actuator (see. e.g. FIGS. 1 to 3, pneumatic linear actuator 23), which is configured to move the lever, wherein, when the lever is moved, the spring is tensioned and a part of the lever is pressed against the mounting plate of the machine tool. As previously mentioned, the spring in the examples described here is a leaf spring which may be made, e.g. of spring steel, and the lever is connected to the frame (e.g. to the base plate of the frame) exclusively by means of the leaf spring.

The may be a pneumatic or an electric direct drive and, in particular, does not include any gears or other rotating parts. An example of a pneumatic direct drive is a bellows cylinder.

In some embodiments the frame comprises a base plate, on which the first end of the spring is clamped by means of a clamping element. The frame may comprise a bracket which is attached to the base plate, wherein, in this example, the actuator is mounted on the bracket (see FIG. 3, actuator 23 is mounted on bracket 25*b* by means of screws 25*d*). The bracket at least partially encloses the lever. In this example, the lever, when mounted, is disposed between the actuator mounted on the bracket and the base plate.

One end of the lever may be bent, wherein the bent end of the lever is pressed against a circumferential surface of the mounting plate when the actuator effects a movement of the lever. By moving the lever, the latter is pressed against the mounting plate of the machine tool (grinding machine), whereby the mounting plate is decelerated and pushed into a defined position.

A further aspect concerns the resonant frequency of the lever (see FIGS. 1 to 3, lever 22) which, regardless of its geometric shape and the rigidity of the material of which it is made, exhibits certain resonant frequencies and their respective modes of oscillation, wherein, as a rule, one resonant frequency (namely the lowest) is the dominant one. In accordance with one embodiment, the lever is constructed such that its dominating resonant frequency is not stimulated while the grinding machine is in operation. This means that the resonant frequency of the lever is higher than a specified maximum rotational frequency (in rotations per second) of the mounting plate of the grinding machine.

Terms such as "first", "second", and the like, are used to describe various elements, regions, sections, etc. and are also not intended to be limiting. Like terms refer to like elements throughout the description.

As used herein, the terms "having", "containing", "including", "comprising" and the like are open ended terms that indicate the presence of stated elements or features, but do not preclude additional elements or features. The articles "a", "an" and "the" are intended to include the plural as well as the singular, unless the context clearly indicates otherwise.

It is to be understood that the features of the various embodiments described herein may be combined with each other, unless specifically noted otherwise.

Although various embodiments have been illustrated and described with respect to one or more specific implementations, alterations and/or modifications may be made to the illustrated examples without departing from the spirit and scope of the appended claims. With particular regard to the various functions performed by the above described components or structures (units, assemblies, devices, circuits, systems, etc.), the terms (including a reference to a "means") used to describe such components are intended to correspond—unless otherwise indicated—to any component or structure that performs the specified function of the described component (e.g., that is functionally equivalent), even if it is not structurally equivalent to the disclosed structure that performs the function in the herein illustrated exemplary implementations of the invention.

It will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

The invention claimed is:

1. An apparatus, comprising:

a machine tool having an eccentrically mounted rotatable mounting plate configured to receive a tool; and a braking device that comprises:

a frame attached to the machine tool;

a leaf spring having a first end fixed on the frame;

a lever connected to a second end of the leaf spring; and an actuator configured to move the lever, wherein when the lever is moved, the leaf spring is tensioned and a part of the lever is pressed against the mounting plate of the machine tool.

2. The apparatus of claim 1, wherein the lever is connected to the frame exclusively by the leaf spring without rotational joints.

3. The apparatus of claim 1, wherein the actuator is a pneumatic or electromagnetic direct drive.

4. The apparatus of claim 1, wherein the actuator is a bellows cylinder.

5. The apparatus of claim 1, wherein the frame comprises a base plate on which the first end of the leaf spring is clamped in place by a clamping element.

6. The apparatus of claim 5, wherein the frame further comprises a bracket attached to the base plate, and wherein the actuator is mounted on the bracket.

7. The apparatus of claim 6, wherein the bracket at least partially encloses the lever.

8. The apparatus of claim 1, wherein one end of the lever is bent, and wherein the bent end of the lever is pressed against a circumferential surface of the mounting plate of the machine tool when the actuator effects a movement of the lever.

9. The apparatus of claim 1, wherein when the lever, by being moved, is pressed against the mounting plate of the machine tool, the mounting plate is decelerated and pushed into a defined position.

10. The apparatus of claim 1, wherein the lever has a dominant resonant frequency higher than a rotational frequency of the machine tool when in operation.

11. The apparatus of claim 1, wherein the machine tool is an orbital grinding machine in which the mounting plate is eccentrically mounted around an axis of rotation.

* * * * *